US006948601B1

(12) United States Patent
Fisher

(10) Patent No.: US 6,948,601 B1
(45) Date of Patent: Sep. 27, 2005

(54) RETRACTABLE ERGONOMIC HANDLE HAVING A BALL AND SOCKET MECHANISM

(76) Inventor: Ethan A Fisher, 14011 Sheri La., Orland Park, IL (US) 60462

( * ) Notice: Subject to any disclaimer, the term of this patent is extended or adjusted under 35 U.S.C. 154(b) by 0 days.

(21) Appl. No.: 10/446,207

(22) Filed: May 27, 2003

(51) Int. Cl.[7] ..... A45B 13/26
(52) U.S. Cl. ..... 190/115; 190/18 A; 16/113.1
(58) Field of Search ..... 190/18 A, 115; 16/113.1

(56) References Cited

U.S. PATENT DOCUMENTS

| | | | | |
|---|---|---|---|---|
| 483,311 | A | 9/1892 | Remaly | |
| 892,105 | A | 6/1908 | White | |
| 1,317,903 | A | 10/1919 | Whimster | |
| 3,342,513 | A | 9/1967 | Melton et al. | |
| 3,433,510 | A | 3/1969 | Hulterstrum | |
| 4,043,686 | A | 8/1977 | Hackett | |
| 4,620,813 | A | 11/1986 | Lacher | |
| 5,098,213 | A | 3/1992 | Day | |
| 5,265,307 | A | 11/1993 | Hull et al. | |
| 5,280,871 | A | 1/1994 | Chuang | |
| 6,238,124 | B1 | 5/2001 | Merlo | |
| 6,360,402 | B1 | 3/2002 | Crabtree | |
| 6,470,533 | B1 | 10/2002 | Comstock | |
| 6,508,344 | B1 * | 1/2003 | Lu | 190/115 |
| 6,530,459 | B1 * | 3/2003 | Lu | 190/115 |
| 6,564,426 | B1 * | 5/2003 | Wang | 16/113.1 |
| 2002/0144874 | A1 * | 10/2002 | Nykoluk et al. | 190/115 |
| 2003/0000785 | A1 * | 1/2003 | Miller et al. | 190/115 |
| 2003/0102195 | A1 * | 6/2003 | Mittleman et al. | 190/115 |
| 2003/0132079 | A1 * | 7/2003 | Bellini | 190/115 |
| 2003/0192146 | A1 * | 10/2003 | Chang | 16/113.1 |

FOREIGN PATENT DOCUMENTS

| | | | | |
|---|---|---|---|---|
| WO | WO01/52687 | * | 7/2001 | A45C 13/26 |

* cited by examiner

*Primary Examiner*—Tri M. Mai
(74) *Attorney, Agent, or Firm*—Michael I. Kroll

(57) ABSTRACT

The present invention 10 discloses a retractably ergonomic handle assembly for use on a conventional wheeled piece of luggage 12. When the present invention 10 is extended from the docked position, the handle 16 member is free to rotate axially as shown by arrows 42 on the handle shaft 32 with integral ball 38 and socket 40 and to pivot 90 degrees in the pivot channel 28 relative to the luggage piece 12 in order to accommodate the preferred angle of the user 14. The handle 16 member may pivot and rotate simultaneously thereby permitting the handle to adjust to the movement of the user 14 while on the move without necessitating awkward adjustments while simultaneously absorbing shock. The handle 16 is fixed to the ball joint assembly 20 by a ball screw 24 extending from the handle 16 through the handle shaft 32 and into the ball of the ball joint assembly 20 providing strength and durability and also allowing quick, inexpensive repair thereof.

7 Claims, 7 Drawing Sheets

RETRACTABLE ERGONOMIC HANDLE HAVING A BALL AND SOCKET MECHANISM

BACKGROUND OF THE INVENTION

1. Field of the Invention

The present invention relates generally to retractable handles for luggage and, more specifically, to an ergonomic handle having a ball and socket mechanism wherein the handle member rotates and pivots on a handle frame accordingly depending upon the height of the user, the angle of the load, the position of the user relative to the luggage piece and other such variables. The handle member pivots and rotates to accommodate the preferred angle of the users hand rather than forcing it to remain in a rigid, unnatural position while bearing a load. The ball and socket mechanism provides for the pivoting and rotating movement of the handle member while maintaining a constant center of gravity.

2. Description of the Prior Art

There are other ball and socket device designed as positionable and/or lockable. Typical of these is U.S. Pat. No. 483,311 issued to Remaly on Sep. 27, 1892.

Another patent was issued to White on Jun. 30, 1908 as U.S. Pat. No. 892,105. Yet another U.S. Pat. No. 1,317,903 was issued to Whimster on Oct. 7, 1919 and still yet another was issued on Sep. 19, 1967 to Melton et al as U.S. Pat. No. 3,342,513.

Another patent was issued to Hulterstrum on Mar. 18, 1969 as U.S. Pat. No. 3,433,510. Yet another U.S. Pat. No. 4,043,686 was issued to Hackett on Aug. 23, 1977. Another was issued to Lacher on Nov. 4, 1986 as U.S. Pat. No. 4,620,813 and still yet another was issued on Mar. 24, 1992 to Day as U.S. Pat. No. 5,098,213.

Another patent was issued to Hull et al on Nov. 30, 1993 as U.S. Pat. No. 5,265,307. Yet another U.S. Pat. No. 5,280,871 was issued to Chuang on Jan. 25, 1994. Another was issued to Merlo on May 29, 2001 as U.S. Pat. No. 6,238,124. Another was issued on Mar. 26, 2002 to Crabtree as U.S. Pat. No. 6,360,402 and still yet another was issued to Comstock on Oct. 29, 2002 as U.S. Pat. No. 6,470,533.

U.S. Pat. No. 483,311

Inventor: Sylvester Remaly

Issued: Sep. 27, 1892

An attachment for plow beams, consisting of the mold board, the pivoted jaws rising therefrom and having concaved inner faces forming sockets, the binding bolt passed the jaws below the sockets and above the pivots, and the shank adapted to be secured to the plow standard and having its lower end terminating between the jaws in a spherical head or ball, substantially as specified through.

U.S. Pat. No. 892,105

Inventor: Charles P. White

Issued: Jun. 30, 1908

Disclosed is a combined pipe support and clamp comprising a supporting member having a cylindrical shank carrying a head provided with longitudinal and latitudinal scores, and a pair of clamping members each having at one end a socket provided with longitudinal and latitudinal scores, the opposed edges of the two sockets being cut away to permit them to straddle the shank and also to be adjusted at an acute angle thereto, and pipe clamping jaws carried by the other ends of the clamping members.

U.S. Pat. No. 1,317,903

Inventor: Peter Whimster

Issued: Oct. 7, 1919

A bracket comprising a pair of similar gripping catches formed from spring wire shaped to present opposing pairs of curved fingers, a universal joint connecting the catches and a fabric lining covering the inner faces of the fingers.

U.S. Pat. No. 3,342,513

Inventor: James O. Melto,n et al

Issued: Sep. 19, 1967

A ball and socket joint assembly comprising: first and second members adapted for movement relative to each other; a metallic socket connected to said first member and having a frusto-spherical cavity therein and having an aperture in one side thereof entering said frusto-spherical cavity, said socket having an annular shoulder formed therein extending in a plane containing a diameter of said frusto-spherical cavity and defining the end thereof, and extending parallel to the plane truncating the cavity to impart frusto-spherical configuration thereto, said shoulder facing toward said aperture, and said metallic socket further having a plurality of grooves formed therein between said shoulder and said aperture in said frusto-spherical cavity; a substantially spherical and unitary synthetic resin liner in said frusto-spherical cavity having a shoulder on its outer periphery engaging said first mentioned shoulder and having ribs on the external peripheral surface thereof extending into, and interlocking with, the grooves in said cavity, said synthetic resin liner having an aperture therein aligned with the aperture in said socket, and having a smooth frusto-spherical internal surface; a ball member positioned inside the liner and including a generally spherical metallic portion and a synthetic resin sheath completely surrounding said metallic portion and secured thereto by interlocking ribs and grooves; and a spindle connected at one of its ends to said ball member and extending therefrom through said apertures and connected at its other end to said second member.

U.S. Pat. No. 3,433,510

Inventor: Harold D. Hulterstrum

Issued: Sep. 26, 1966

A swivel structure for rigidly joining first and second parts together at a selected orientation, said structure comprising a first member connected to said first part, a second member connected to said second part, an intermediate substantially hollow plastic member interconnecting said first and second members and thereby said first and second parts together, an enlarged outer end portion on said first member, a plurality of locking means on said outer end portion, a neck portion on said first member and being adjacent said enlarged outer end portion, means on said second member for engaging a selected one of said locking means, means for threadably and adjustably joining said hollow member and said second member together, a slotted portion on said hollow member including an enlarged transverse opening for passing said enlarged outer end portion therethrough, said slotted portion also including a restricted opening axially aligned with said threadable joining means for slidably receiving said neck portion, axial flange portions defining said restricted opening and opposing the forces imparted as said second member is threadably joined to said hollow portion, said enlarged outer end portion being interposed between said restricted opening and said engaging means.

U.S. Pat. No. 4,043,686

Inventor: Kenneth R. Hackett

Issued: Aug. 23, 1977

A ball joint for support of and orientation of a device in any direction stabilized against rotation on its own axis including means locking the ball in a selected position.

U.S. Pat. No. 4,620,813

Inventor: William A. Lacher

Issued: Nov. 4, 1986

The present disclosure describes a mechanism for positioning a pair of members in slip-free, adjustable, angular relationships. In accomplishing the foregoing, an assembly is provided which comprises a sphere and a pair of pivotally mounted jaw-like sections for engaging the latter. The inner surfaces of the sections have substantially the same radius of curvature as the sphere surface. Additionally, the sphere surface and the inner surfaces of the jaw-like sections are configured in respective interlocking patterns. Manipulation of the jaw-like sections allows the members to be placed in the desired angular position with respect to each other—which position is maintained by virtue of the aforementioned interlocking nature of the contiguous surfaces.

U.S. Pat. No. 5,098,213

Inventor: Robert L. Day

Issued: Mar. 24, 1992

A ball joint comprises companion inner and outer hollow ball sections each comprising a major segment of a sphere. Spring means within the ball sections urges a friction pad into engagement with the interior surface of one of the sections. Screws within the ball sections adjusts the spring force, the screws being accessible for movement through a series of openings in one of the ball sections.

U.S. Pat. No. 5,265,307

Inventor: Harold L. Hull

Issued: Nov. 30, 1993

Disclosed is an ergonomic handle which may be attached to any suitable object such as a briefcase, luggage, instrument cases, etc., which may then be adjustable through its vertical and horizontal axis and moved forward or backward on its mounting base to locate the most optimum balance point and the best ergonomic relationship between the fingers, wrist, elbow and shoulder of the user.

U.S. Pat. No. 5,280,871

Inventor: Chiang-Pao Chuang

Issued: Jan. 25, 1994

A securing base having a round base of three layers to support a pressing disc combined with a supporter, a shaft passing through the pressing disc to engage the round base by means of threads, a ball at a bottom of a movable rod fitting in a spherical hole in an upper portion of the movable rod, the ball having a plurality of small holes for a pin end of the supporter to selectable in an angle needed.

U.S. Pat. No. 6,238,124

Inventor: Werner O. Merlo

Issued: May 29, 2001

The locking joint mechanism disclosed in U.S. Pat. No. 5,588,767 is improved by including elements that prevent roll of one joint member relative to another joint member. The roll preventing elements include at least one actuator head or pin spaced from another actuator head or pin and which is received in a concavity defined between adjacent protuberances. Various protuberance patterns and overall operating mechanisms are also disclosed.

U.S. Pat. No. 6,360,402

Inventor: Amy Marie Crabtree

Issued: Mar. 26, 2002

Travel case pull handle having: a pair of C-shaped tubular members connected on one longitudinal side by a hinge member, a centrally located bearing capable of retaining and L-shaped arm, the arm terminating in a ball joint, the ball joint fitted into a ball socket, the ball socket connected to a handle, the handle being ergonomically shaped to fit a users gripped hand and having a downwardly extending portion which cradles the users fore finger and thumb, said C-shaped tubular members having hook type fastener material on one outer surface and a pair of fabric loop fastener strips extending from said opposite C-shaped tubular member, and the inside of said C-shaped tubular members each having resilient compressible, longitudinally running strips.

U.S. Pat. No. 6,470,533

Inventor: Troy C. Comstock

Issued: Oct. 29, 2002

A universal luggage handle is provided for use with luggage to effectuate the moving of the luggage, with the luggage handle including a hand grasp, an intermediate member rotatably secured to the hand grasp, and a strap portion, with the strap portion secured to the intermediate member, and with the strap portion having fastening means to secure the strap portion to itself. The intermediate member has a base portion and at least one strap attachment portion. The hand grasp pivots relative to the intermediate member. The intermediate member has a gasket surrounding a section of the strap attachment portion, with the gasket being in contact with strap attachment portion, and with the gasket being in contact with the strap portion. The strap portion has a first side and a second side, with the first side being generally planar, but preferably having a raised portion. In the preferred embodiment of the invention, the hand grasp is separated from the intermediate member by a grommet. More preferably, this grommet is fabricated from rubber. Each strap attachment portion has a longitudinal axis of attachment associated therewith, such that the strap portion freely rotates about the longitudinal axis. Several modified embodiments are disclosed.

While these ball and socket devices may be suitable for the purposes for which they were designed, they would not be as suitable for the purposes of the present invention, as hereinafter described.

SUMMARY OF THE PRESENT INVENTION

The present invention discloses a retractable ergonomic handle assembly for use on a conventional wheeled piece of luggage. When the present invention is extended from the docked position, the handle member is free to rotate axially on the handle shaft with integral ball and socket and to pivot 90 degrees in the pivot channel relative to the luggage piece in order to accommodate the preferred angle of the user. The handle member may pivot and rotate simultaneously thereby permitting the handle to adjust to the movement of the user on the move without necessitating awkward adjustments while simultaneously absorbing shock. The handle is fixed to the ball joint assembly by a ball screw extending from the handle through the handle shaft and into the ball of the ball joint assembly providing strength and durability and also allowing quick, inexpensive repair thereof. Also shown are the ball joint assembly housing, handle frame and retractable shafts.

A primary object of the present invention is to provide a retractable handle assembly for luggage having a pivotable and rotatable handle member that will adjust to conform to the appropriate position to maximize the comfort level of the user.

Another object of the present invention is to provide a retractable handle for luggage.

Yet another object of the present invention is to provide a handle wherein said ball can be repositioned relative to said socket.

Still yet another object of the present invention is to provide a handle for luggage wherein the handle can be repositioned relative to the body of the user.

An additional object of the present invention is to provide a handle operatively connected to a ball that is rotatively repositionable within a socket.

A further object of the present invention is to provide a handle having connection with said ball.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
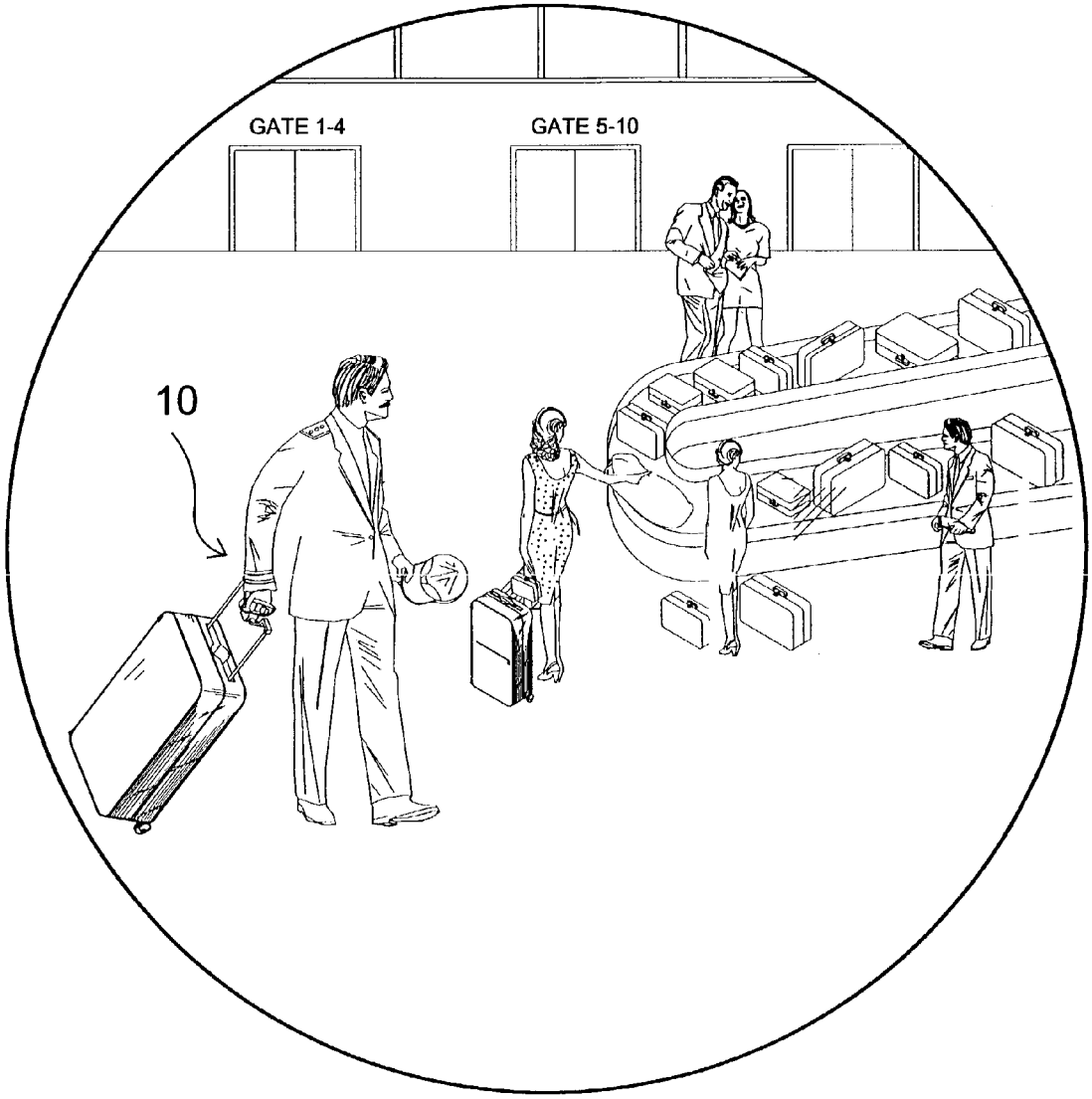
FIG. 1 is an illustrative view of the present invention in use.

With regard to reference numerals used, the following numbering is used throughout the drawings.

10 present invention
12 luggage
14 user
16 handle
18 handle frame
20 ball joint assembly
22 retractable shaft
24 ball screw
26 docking recess
28 pivot channel
30 ball joint assembly housing
32 handle shaft
34 brace
36 retractable shaft support
38 ball
40 socket
42 arrows
44 arrow
46 shaft channel
48 washer
50 screw threads

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a retractable, rotatable, pivoting handle designed primarily for wheeled luggage 12 that is meant to be pulled by the user 14. The handle of the present invention 10 is designed to provide for the 360-degree axial rotation thereof when in use as well as being able to pivot 90 degrees in one direction in a perpendicular relation to the handle frame assembly. The multidirectional movement of the handle of the present invention 10 provides enhanced ergonomic benefits to the user 14 since the handle is constantly adapting to the individual needs of the user rather than forcing the user to pull and maneuver a heavy piece of luggage 12 while their hand is forced into an unnatural and potentially damaging position as is common in the prior art.

Figure 2:
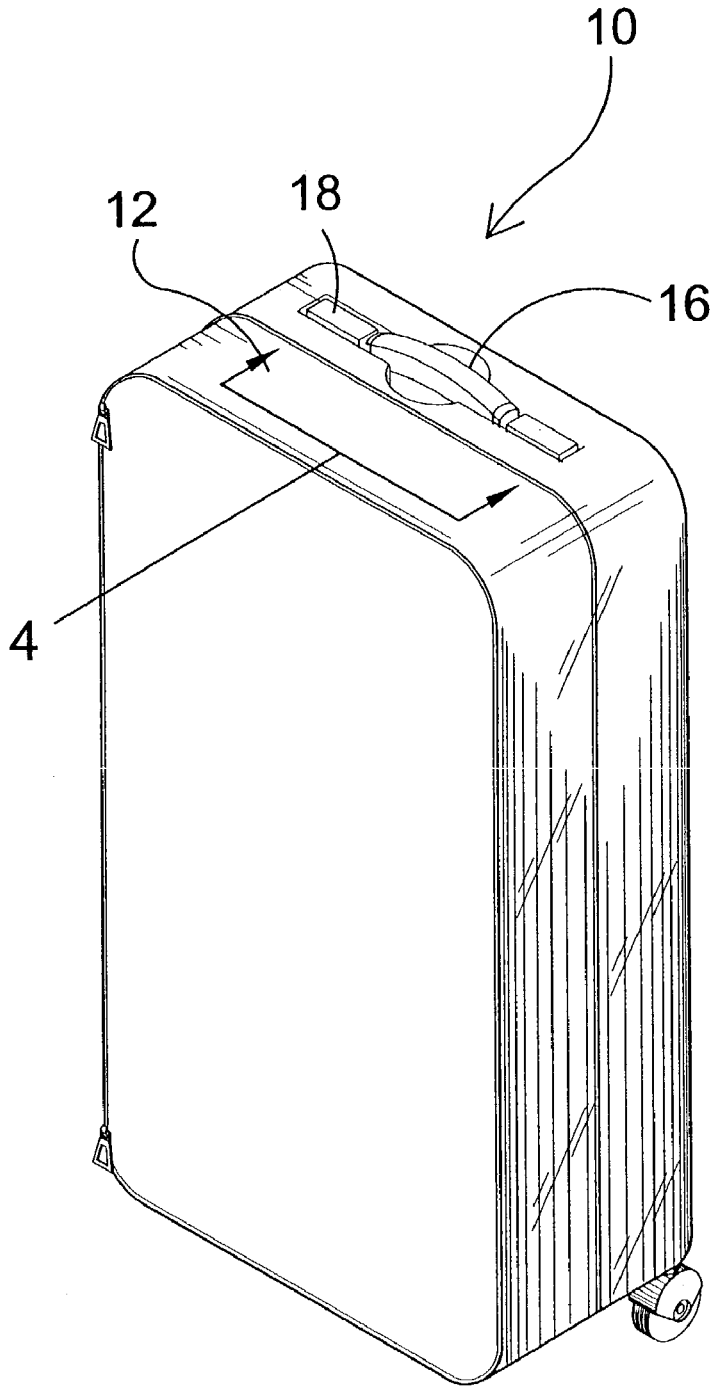
FIG. 2 is a perspective view of the present invention. Shown is the present invention incorporated into luggage.

Turning to FIG. 2, shown therein is a perspective view of the present invention 10 in use. Shown is the present invention 10 incorporated into a conventional piece of luggage 12. The handle 16 is in the docked, retracted position where it is substantially flush with the surface of the luggage piece. The handle frame 18 is also shown.

Figure 3:
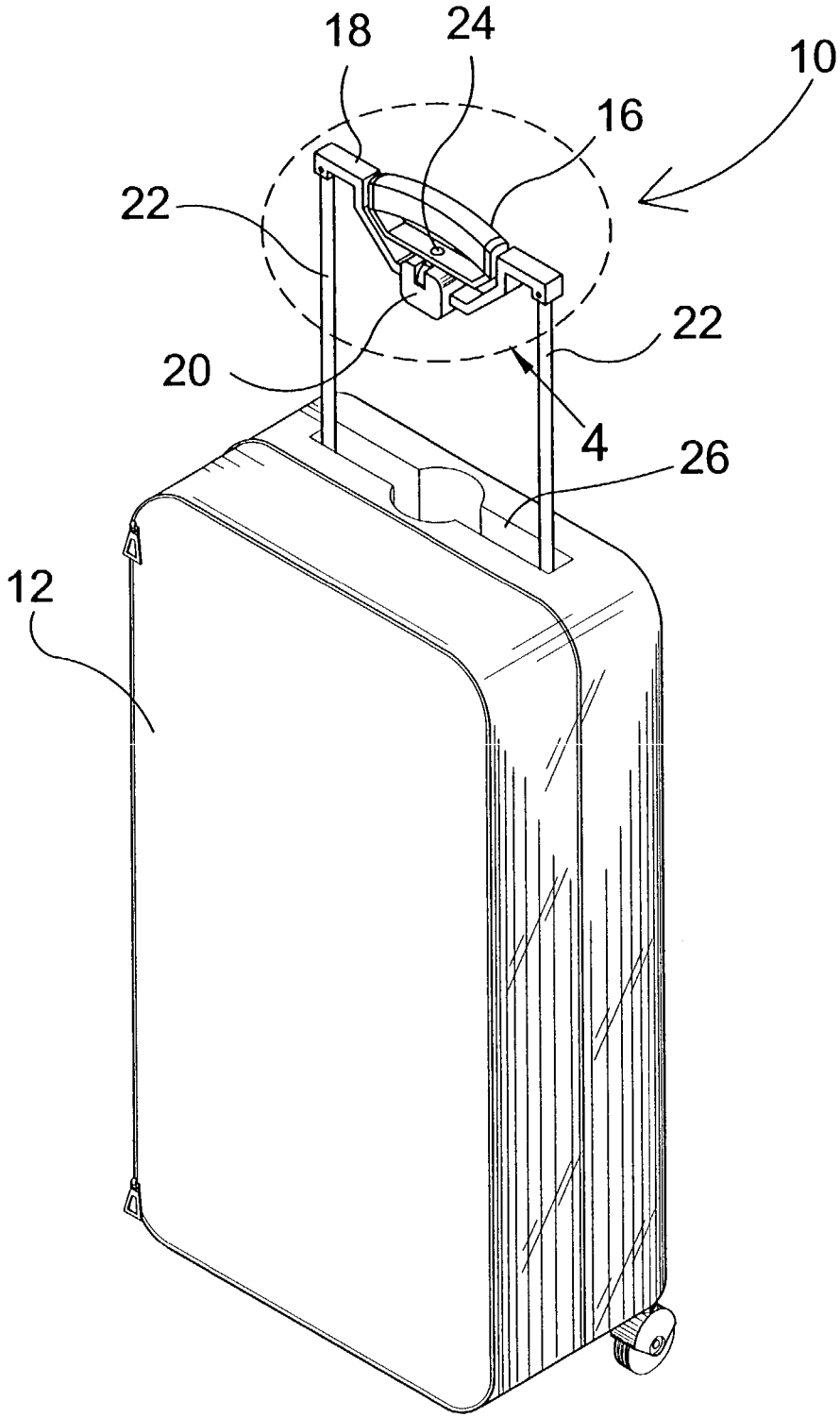
FIG. 3 is a perspective view of the present invention extended.

Turning to FIG. 3, shown therein is a perspective view of the present invention 10. Shown is the present invention 10 incorporated into luggage 12 and fully extended. The handle 16 is pivotally and rotatably connected to a handle frame 18 by means of a ball joint assembly 20. The handle assembly means of the present invention 10 communicates between two retractable shaft members 22 that slide within their respective channels which are integral with the luggage piece 12. Also shown are a ball screw 24 and docking recess 26.

Figure 4:
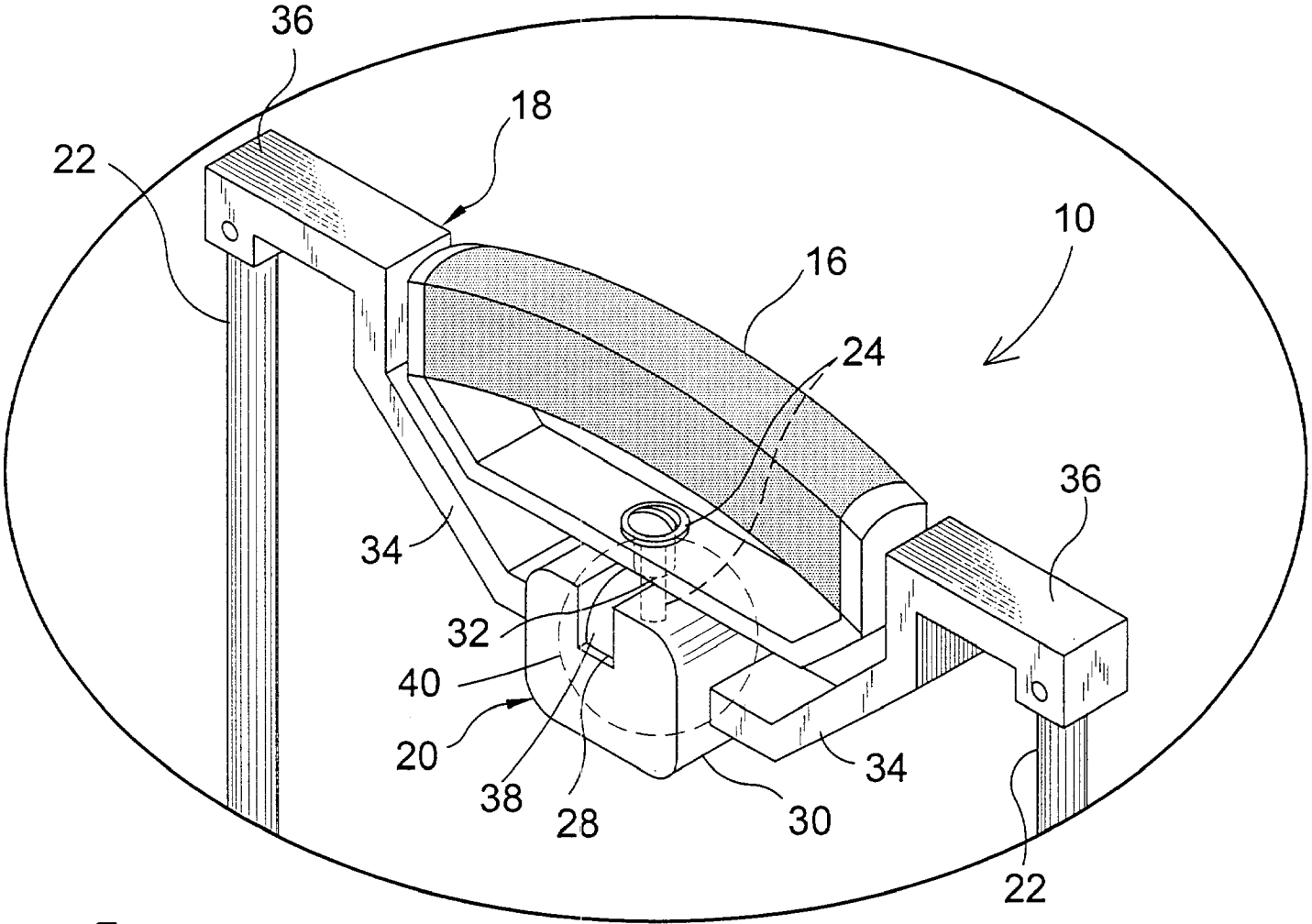
FIG. 4 is a detailed perspective view of the present invention.

Turning to FIG. 4, shown therein is a detailed perspective view of the present invention 10. Shown is the present invention 10 which discloses a handle 16 having means for connection to a handle frame 18 using rotatively mating ball 38 and socket 40 forming a ball joint assembly 20 with the socket integral with the luggage. The handle 16 comprises an ergonomically shaped curved foam or rubber shaped grip member, providing safety and comfort to the user. The handle 16 rotates when not being pulled to a desired position. In any desired position, the handle 16 is strong enough to be put into any position for ease of turning or maneuvering the luggage having the device 10 installed thereon by moving within the pivot channel 28 of the ball joint assembly 20. Also shown are a ball joint assembly housing 30, ball screw 24, handle shaft 32, brace members 34, retractable shaft 22, retractable shaft support 36 and handle frame 18. The handle frame 18 is offset in its middle portion downwardly a distance effective to allow the top of handle 16 to be substantially level with the top of the handle frame.

Figure 5:
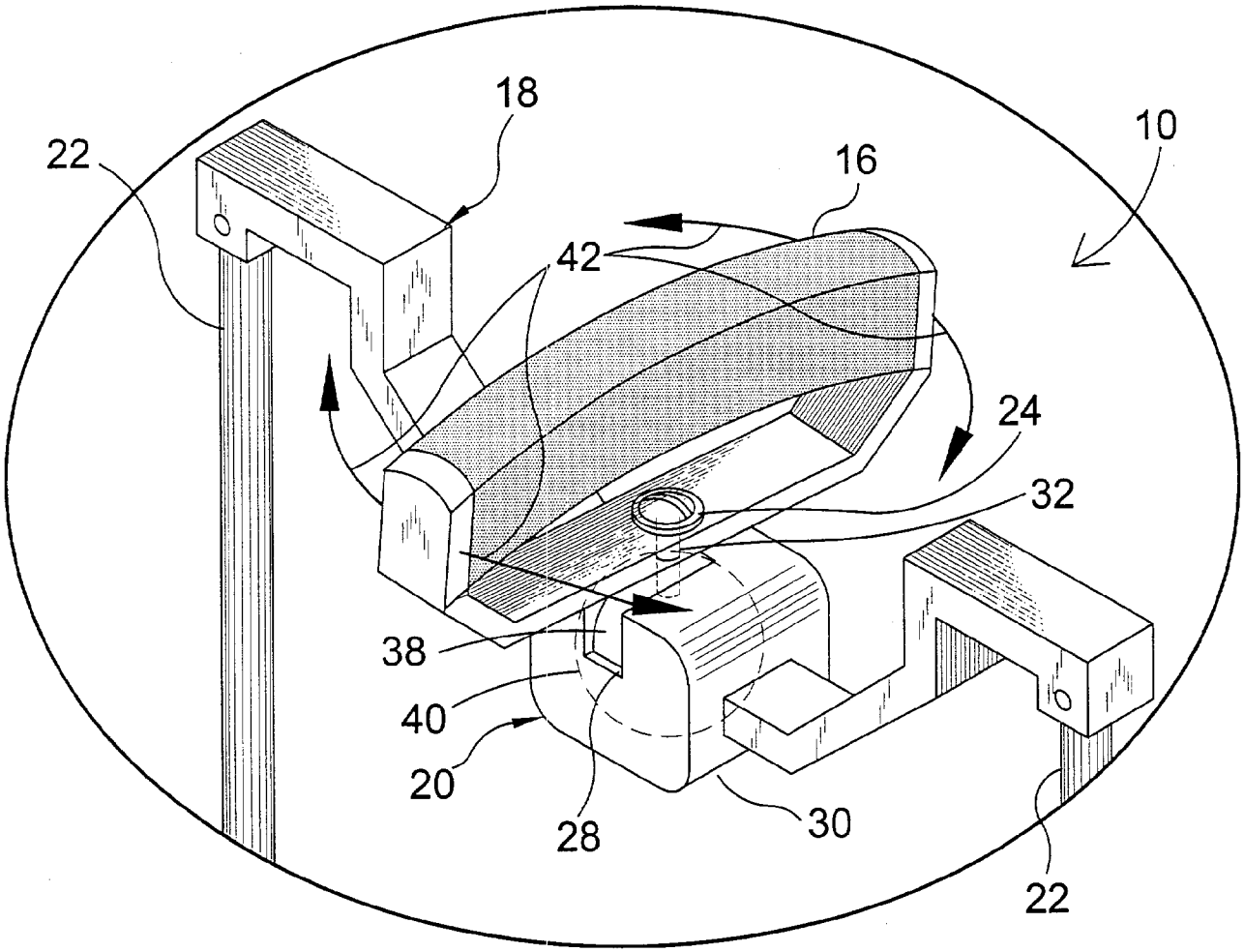
FIG. 5 is a detailed perspective view of the present invention.

Turning to FIG. 5, shown therein is a detailed perspective of the present invention 10 in use. Once the handle assembly of the present invention 10 is extended from the docked position, the handle 16 member is free to rotate 360 degrees axially as shown by arrows 42 on the handle shaft 32 with integral ball 38 and socket 40 and to pivot 90 degrees in the pivot channel 28 relative to the luggage piece in order to accommodate the preferred angle of the user. The handle 16 member may pivot and rotate simultaneously thereby permitting the handle to adjust to the movement of the user on the move without necessitating awkward adjustments while simultaneously absorbing shock. The handle 16 is fixed to the ball joint assembly 20 by a ball screw 24 extending from the handle 16 through the handle shaft 32 and into the ball 38 of the ball joint assembly 20 providing strength and durability and also allowing quick, inexpensive repair thereof. Also shown are the ball joint assembly housing 30, handle frame 18 and retractable shafts 22.

Figure 6:
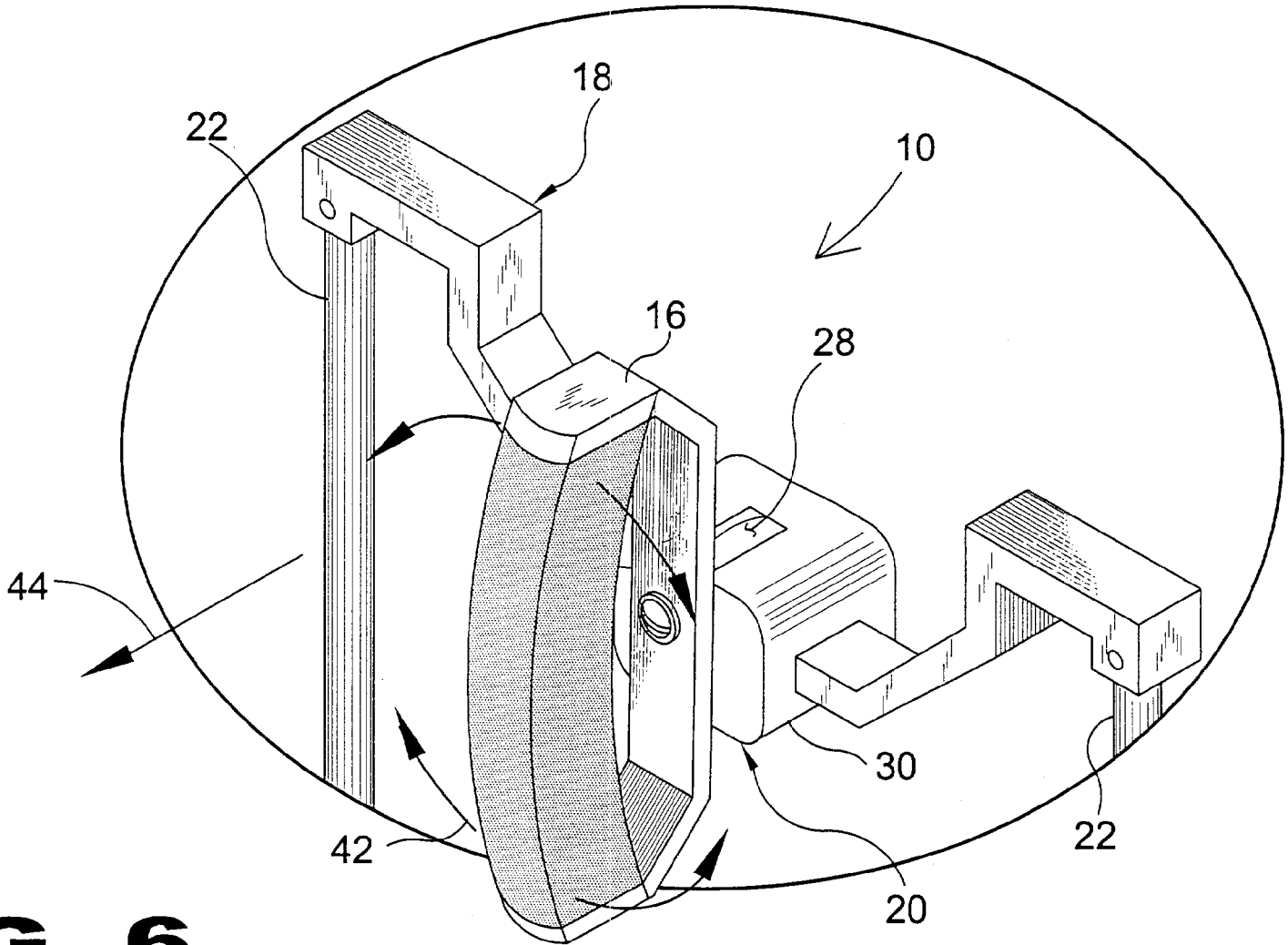
FIG. 6 is a detailed perspective view of the present invention.

Turning to FIG. 6, shown therein is a detailed perspective view of the handle 16 of the present invention 10 pivoted 90 degrees from the docked position as shown by arrow 44. Shown is the handle 16 member pivoted within the pivot channel 28 which allows pivoting in only one direction. The handle 16 member can still rotate as shown at 42 as needed while pivoting to afford the user the most comfortable angle as well as acting as a shock absorber in order to reduce the risk of straining or fatiguing the wrist, elbow and shoulder of the user bearing the load. Also shown are the ball joint assembly 20 and housing 30, the handle frame 18, and retractable shaft 22.

Figure 7:
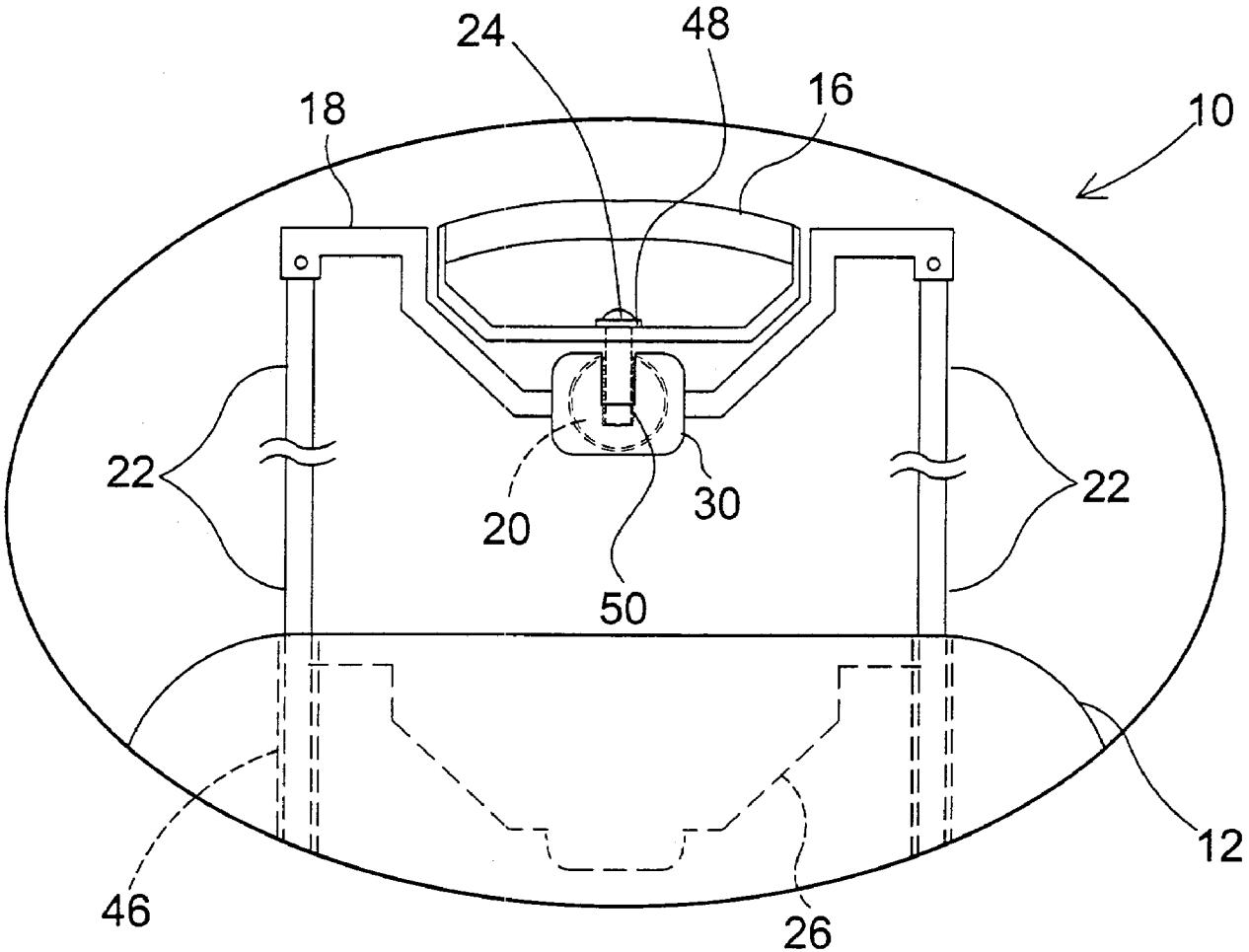
FIG. 7 is a front view of the present invention extended from the host luggage.

Turning to FIG. 7, shown therein is a front view of the present invention 10 in an engaged position. The present invention 10 is shown extending from the host luggage 12. The docking recess 26 and shaft channels 46 are depicted in hidden line. Also shown are handle 16 and frame 18, ball joint assembly 20 and housing 30, ball screw 24 with washer 48 thereon and screw threads 50, along with retractable shaft 22.

I claim:

1. An apparatus for an ergonomic handle with a wheeled piece of luggage in combination, comprising:

a) a wheeled piece of luggage to which the apparatus is attached, said luggage having a lower wheeled end and an upper end, said upper end having a docking recess therein and a pair of parallel channels therein, wherein the apparatus is attached to said upper end;

b) a pair of parallel retractable shafts disposed on said upper end of said luggage, said shafts each having a first and second opposing end, wherein one of each pair of said retractable shafts are disposed in one of each pair of said parallel channels to permit said first end of said shafts to be extended from said channels while said second end of said shafts remain securely disposed internal said channels;

c) a handle device being connected to each of said first ends of said shafts whereby the handle device is 360 degrees rotatable axially and 90 degrees pivotal from the axial direction with respect to said retractable shafts; and, d) wherein said handle device is docked in said docking recess when said first end of said shafts are retracted into said channels to permit the handle device to be stored in the docking recess of the piece of luggage, wherein said handle device i) a handle frame having first and second opposing ends, wherein said first end is connected to a first member of said pair of retractable shafts and said second end is connected to a second member of said pair of retractable shafts, said handle frame having a top side oriented away from said piece of luggage and a bottom side oriented toward said piece of luggage;

ii) a handle disposed intermediate said first and second ends of said handle frame, said handle having a top side and a bottom side; and, iii) means for connecting said handle to said handle frame whereby said handle is 360 degrees rotatable axially and 90 degrees pivotal from the axial direction with respect to said pair of retractable shafts, said means for connecting said handle to said handle frame comprises a ball joint assembly housing disposed on said handle frame intermediate said first and second ends thereof said housing having a pivot channel therein; and a ball joint assembly disposed internal said ball joint assembly housing to permit the handle to be 360 degree axially rotatable and 90 degree pivotal with respect to the pair of retractable shafts, said ball joint assembly comprising a ball and a joint, wherein said handle frame is offset intermediate said first and second ends thereof toward said bottom side thereof a distance effective to permit said top of said handle to be substantially level with said top of said handle frame and said handle is ergonomically shaped to permit the handle to be held safely by a user.

2. The apparatus of claim 1, wherein said housing has a top, a bottom, and four sides, wherein a first and second side of opposing said four sides face said first and second corresponding ends of said handle frame and a third and fourth side of opposing said four sides face in a direction perpendicular to said handle frame, wherein said pivot channel extends from said top side of said housing to one only of either said third or said fourth sides of said housing to permit said handle to pivot 90 degrees therein, wherein said top of said housing and said top of said handle are oriented in the same direction.

3. The apparatus of claim 2, further comprising a shaft being connected to said top of said ball and said bottom side of said handle, said shaft being disposed in said pivot channel to permit the shaft to pivot 90 degrees from the top of the ball joint assembly housing to the side of the ball joint assembly housing.

4. The apparatus of claim 3, wherein said shaft is rotatably connected to said handle to permit said handle to axially rotate 360 degrees.

5. The apparatus of claim 4, wherein said shaft has a throughbore therein, further comprising a screw having a head on one end and threads on a second end, said screw extending through said throughbore, wherein said head of said screw is connected to said bottom of said handle and said threads of said screw are threaded into said top of said ball.

6. The apparatus of claim 5, further comprising a washer disposed on said head of said screw to permit said handle to rotate axially thereon.

7. The apparatus of claim 6, wherein said ball joint assembly housing is round in shape.

* * * * *